US005753381A

United States Patent [19]

Feldman et al.

[11] Patent Number: 5,753,381

[45] Date of Patent: May 19, 1998

[54] ELECTROLUMINESCENT FILAMENT

[76] Inventors: Michael C. Feldman, 1011 Cherry St., San Carlos, Calif. 94070; Bryan D. Haynes, 19 Alcala Ct., Pacifica, Calif. 94044

[21] Appl. No.: 578,887

[22] Filed: Dec. 22, 1995

[51] Int. Cl.[6] ..... H05B 33/00

[52] U.S. Cl. ..... 428/690; 313/506; 313/511; 362/84

[58] Field of Search ..... 428/690; 313/506, 313/511; 362/84

[56] References Cited

U.S. PATENT DOCUMENTS

| | | | |
|---|---|---|---|
| 3,052,812 | 9/1962 | Dow | 313/108 |
| 3,069,579 | 12/1962 | Berg et al. | 313/108 |
| 3,278,784 | 10/1966 | Masaharu | 313/108 |
| 3,571,647 | 3/1971 | Robinson | 313/108 |
| 3,803,437 | 4/1974 | Robinson | 313/108 |
| 3,819,973 | 6/1974 | Hosford | 313/498 |
| 5,381,310 | 1/1995 | Brotz | 362/32 |
| 5,485,355 | 1/1996 | Voskoboinik et al. | 362/84 |

OTHER PUBLICATIONS

Brochure of Electroluminescent Industries Ltd. (Rev. 4 16–Apr.–96).

*Primary Examiner*—Charles Nold
*Attorney, Agent, or Firm*—Limbach & Limbach L.L.P.

[57] ABSTRACT

An electrically activated light emitting cylindrical or other shaped composite filament. A core conductor is optionally surrounded by a first optional insulation layer, surrounded by an electrode and an electroluminescent phosphor. The entire assembly may be coated with a second insulation layer. Light is produced by the phosphor when the core conductor and the electrode are connected to and energized by an appropriate electrical power supply. The filament may be used to form various one-, two- and three-dimensional light emitting objects.

16 Claims, 6 Drawing Sheets

ELECTROLUMINESCENT FILAMENT

BACKGROUND OF THE INVENTION

1. Field of the Invention

The present invention relates to electroluminescent filaments.

2. Description of the Related Art

Electroluminescing fibers have been known generally in the art, but few have been produced beyond a test scale. Generally, such electroluminescing fibers may contain a material, such as a phosphor, that luminesces in an electric field.

Such fibers, however, have had a series of problems, including low reliability. These fibers also lack sufficient flexibility to be made into one-, two-, and three-dimensional light emitting objects using textile fabrication technologies such as knitting, weaving, braiding, etc., that use raw materials in filamentary form.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention comprises: a core conductor; a luminescing layer surrounding the core conductor; and an electrode surrounding the core conductor.

The electroluminescent filament product may be used to fabricate all sorts of useful shapes that emit light when connected to and energized by the appropriate electrical power supply. Textile fabrication technologies such as knitting, weaving, braiding, etc., that use raw materials in filamentary form may be used to make all sorts of one, two, and three dimensional light emitting objects.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DESCRIPTION OF THE PREFERRED EMBODIMENT

A electroluminescent filament may contain a core conductor, an optional first insulation layer surrounding the core conductor and a luminescing layer surrounding the insulation layer. An electrode may surround the luminescing layer. In an alternative embodiment, the electrode may be embedded in the second insulation layer or may be embedded in the luminescing layer. To provide strength while maintaining flexibility, the core may be multistranded and the electrode braided. Additional braided layers may be added to improve strength, cut-through resistance, etc.

The electroluminescent filament produces light in response to alternating or pulsed DC current input. The core conductor and the electrode can be connected across a voltage source in order to produce light as desired. It is possible to use more than one voltage source with a single filament. This may be the case if more than one electrode is present in the filament or if a multi-stranded core conductor is used.

The electroluminescent filament may be used to fabricate shapes that emit light when they are connected to and energized by the appropriate electrical power supply. Textile fabrication technologies such as knitting, weaving, braiding, etc., that use raw materials in filamentary form may be used to make all sorts of one, two, and three dimensional light emitting objects. Examples of such objects include clothing, works of art, molded parts, and informational displays. In clothing, for example, electroluminescent threads can be used to embroider logos, designs, or other accents.

Figure 1:
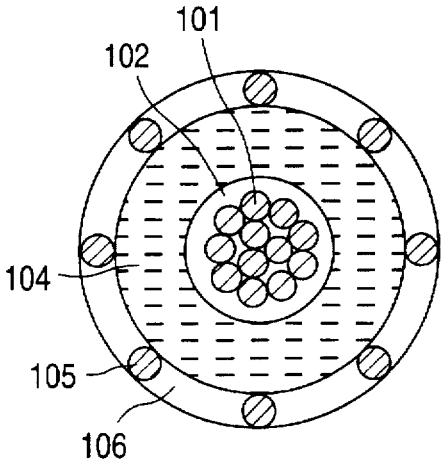
FIG. 1 shows a cross-section of an embodiment of the electroluminescent filament of the invention.

FIG. 1 shows a particular embodiment of an electroluminescent filament. The filament has a core conductor 101 located at or near the center of the filament. The core 101 is a conductor or semi-conductor, and may be of a single or multiple filamentary metallic or carbonaceous material, other electrically conducting or semi-conducting materials or combinations thereof. The core conductor 101 may be solid or porous. The cross-sectional shape of the core conductor 101 may be circular, flat, or any other acceptable geometry. Preferably, the core conductor 101 is a multiple-strand configuration of conducting filaments because bundles of fine filaments are more flexible than a solid individual filament. The multiple-strand configuration adds strength and flexibility to the filament.

Accordingly, in a preferred embodiment of the filament, the core conductor is a multistrand core conductor. These multistrand core conductors may be in a parallel, coiled, twisted, braided, or another acceptable configuration or arrangement. The number of strands, their individual diameters, composition, the method of packing and/or number of twists may be of any combination.

The filament or filaments of the core conductor may be surrounded by an optional first insulation layer 102 of insulating material. While the first insulating layer 102 is not required to practice the invention, its presence is preferred. The first insulating layer 102 serves to reduce the probability of shorts between the core conductor and an electrode, thus increasing reliability.

In the embodiments shown in FIG. 1, the first insulation layer 102 surrounds the core conductor. In the case of a multistrand core conductor, each strand may be individually surrounded by an optional first insulation layer. An additional insulation layer may also surround the entire bundle of individually surrounded strands.

A particularly preferred core conductor material is a 19-strand bundle of stainless steel conductor filaments. Each strand (filament) is about 50 gauge (roughly equivalent to about 0.001 inch dia.). Each strand bundle has a fluorinated ethylene propylene (FEP) insulation layer about 0.002 inch thick, with an overall wire conductor outside diameter of about 0.012 inch (insulation inclusive). Such a core conductor is available from Baird Industries (Hohokus, N.J.).

A luminescing layer 104 surrounds the insulation layer or layers. The luminescing layer 104 preferably comprises "phosphor." Phosphor is a term that has evolved to mean any material that will give off light when placed in an electric field. The light may be of a variety of wavelengths. The luminescing layer 104 may be deposited as a continuous or interrupted coating on the outer surface of the core conductor's insulation layer. When the luminescing layer 104 is deposited as an interrupted coating, the result may a striped or banded, light producing product. If there is a plurality of individually insulated strands, the luminescing layer may be coated on each strand or disposed between the insulated strands.

Alternatively, the phosphor may be compounded directly into the first insulation layer and applied by extrusion or another process. In this embodiment, the first insulation layer and the luminescing layer are the same layer.

Typically, phosphor is comprised of copper and/or manganese activated zinc-sulfide particles. In a preferred embodiment, each phosphor particle is encapsulated to improve service life. The phosphor may be either neat or in the form of a phosphor powder/resin composite. Suitable resins include cyanoethyl starch or cyanoethyl cellulose, supplied as Acrylosan® or Acrylocel® by TEL Systems of Troy, Mich. Other resins, possessing a high dielectric strength, may be used in the composite matrix material.

A particularly preferred material for use in the luminescing layer 104 is the phosphor-based powder known as EL phosphor, available as EL-70 from Osram Sylvania Inc. (Towanda, Pa.). A preferred formulation for the composite is 20% resin/80% phosphor by total weight of the composition. However, other weight ratios may be used.

Other phosphors are available which emit different wavelengths of radiation, and combinations of phosphers may be used.

The luminescing layer 104 may be deposited in any number of ways, such as: thermoplastic or thermoset processing, electrostatic deposition, fluidized powder bed, solvent casting, printing, spray-on application or other acceptable methods.

Another method for attaching the luminescing layer 104 to the first insulation layer, or to other suitable layers, if suitable for use with the materials in question, is to soften the first insulation layer 102, or other suitable layers with heat, or a solvent or other method and then to imbed the phosphor material into the first insulation layer 102, or other suitable layers.

The luminescing layer 104 may be attached to the outermost surface of the first insulation layer 102 using one or more adhesion promoting interlayers. Interlayers 103 may be used generally to promote interlayer adhesion, or for other desired effects, such as modification of dielectric field strength or improved longitudinal strain performance. To promote adhesion to the surface of the first insulation layer, any process to modify the surfaces properties may be used, such as: mechanical abrasion, chemical etching, physical embossing, laser or flame treatment, plasma or chemical treatment or other processes to improve the surface properties.

An electrode 105 surrounds the luminescing layer 104 or may be embedded in a second insulation layer 106. The electrode 105 may also be applied before or simultaneously with the luminescing layer 104. The electrode 105 comprises an electrically conductive or semi-conductive material, and preferably, the electrode has a braided filamentary structure. The filaments may be coated or uncoated. Examples of suitable electrode materials include metal, carbon, metal coated fibers, inherently conducting polymers, intrinsically conducting polymers, compounds containing indium tin oxide, and semiconductors. Other electrode configurations include: perforated wrap-around metallic foils (wherein the perforations may be of any shape, i.e. circular, slot or other); wrap-around ITO (indium tin oxide) coated optical transparent tape; electrically conducting knitted, woven or non-woven cloth or fabric; non-woven mat material such as overlapping electrically conducting whiskers or tinsel; any other electrical conductor; or any combination of these materials.

A filamentary electrode structure containing elongated, oriented, and/or cross-linked polymer material has the ability to shrink when heated. Thus, if the electrode shorts to the core conductor, the filaments of the filamentary electrode structure would shrink away from the damaged area. This serves to reduce the effects of the short. Another method of making an electrode shrink or move away from a short is to use fiber electrodes comprised of low melting point metal alloys i.e. bizmuth/tin.

Polymeric materials may possess shrink properties. The ability of a material to change its shape may be manifested by numerous different mechanisms. Thermoset (cross linked) and thermoplastic polymeric macro molecular materials in fiber or film or 3-dimensional form may be either warm (hot) or cold processed to yield elongated (stretched) materials. These elongated materials will shrink or relax when they are softened with heat. Typically, hot (warm) processing involves elongating cross linked materials where the chemical bonds (cross links) are strained during the elevated temperature elongation process. These strained bonds are held or maintained under stress when the elongated material is cooled to room temperature. Subsequent heating softens the material and allows the material to relieve its internal strains and stresses resulting in material shrinkage.

Cold processing of thermoplastic materials causes the amorphous regions of the material to be oriented/elongated and typically oriented into a crystalline or pseudo crystalline morphology. Subsequent heating will cause these oriented/elongated regions to relax—once again the material will shrink. Cross linked polymeric materials are typically made by using one of the following processes: electron beam (beta rays) cross linking of neat or additive containing materials; gamma ray induced cross linking, or thermal induced cross linking facilitated by additives, i.e., peroxides.

The electrode 105 may be surrounded by, or may be embedded within, the second insulation layer 106. The second insulation layer 106 is preferably comprised of an optically transparent, electrically insulating material, such as an amorphous or crystalline organic or inorganic material. The second insulation layer 106 may be applied in liquid or other form with a subsequent cure or other process that may result in a permanent, semi-permanent, or temporary protective layer. Particularly preferred materials include epoxies, silicones, urethanes, polyimides, and mixtures thereof. Other materials may be used to achieve desired effects. The transparent, electrically insulating, materials may also be used in other layers.

The second insulation layer 106 is not required, but is desirable to improve reliability. The second insulation layer 106 also improves the "feel" (i.e. surface texture) of the filament and resulting goods made from the filament.

A silicone coating resin, such as Part No. OF113-A & -B, available from Shin-Etsu Silicones of America (Torrance, Calif.), may be used for the second insulation layer 106. The silicone resin KE1871, available from Shin-Etsu Silicones of America, may also be used for the second insulation layer 106.

The materials and layers described in this embodiment, and any additional layers, conform generally to the descriptions provided elsewhere in this specification. When a layer or element of the filament is said to surround another layer or filament, it may surround the other layer or filament in a concentric or non-concentric fashion.

Alternate arrangements also may result in a light emitting EL filament or fiber.

Figure 2:
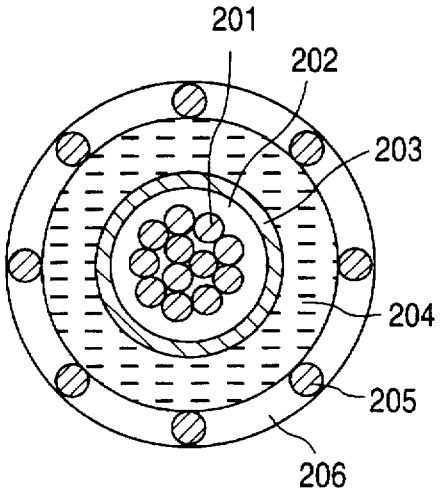
FIG. 2 shows a cross-section of an embodiment of the electroluminescent filament of the invention.

FIG. 2 shows a core conductor 201, surrounded by a first insulation layer 202, which is surrounded by an interlayer 203. The interlayer 203, is surrounded by the luminescing layer 204, which is surrounded by a second insulation layer 206, having embedded within it an electrode 205.

Figure 3:
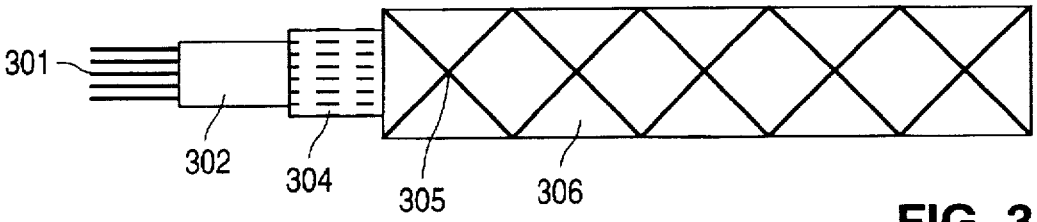
FIG. 3 shows a longitudinal elevation of the electroluminescent filament of the invention.
Figure 10:
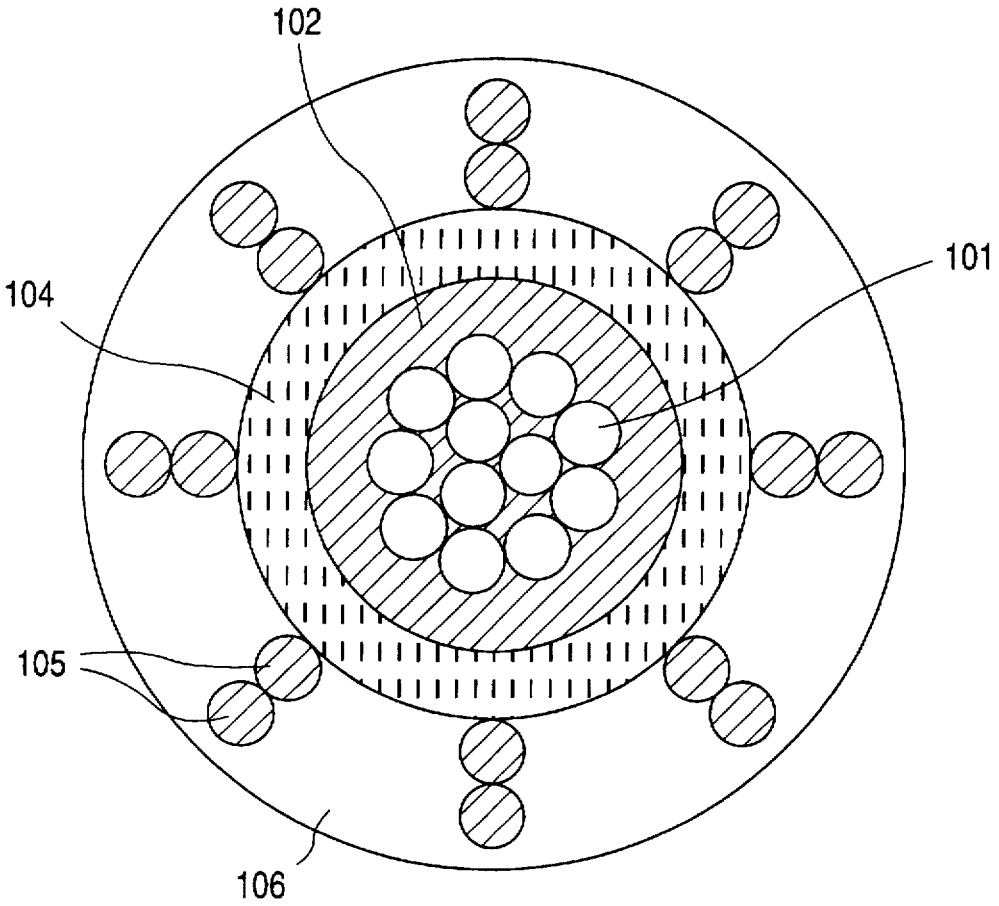
FIG. 10 shows a cross-section of an embodiment of the electroluminescent filament of the invention.

As shown in FIG. 3, the electrode 305 may be a braided structure. A braided structure may include three or more electrode filaments forming a regular diagonal pattern. The electrode filaments may be intertwined. The braided structure may form wire grid. Braids may include counterwound electrodes having an under and over geometry. FIG. 10 shows a more detailed depiction of the over and under geometry of a counterwound braid 105. Braided structures tend to add strength and flexibility to the filament.

The braided electrode may be formed from several different wires which can have the same or different gauges. The wires can have the same or different sizes, shapes, and compositions. The wires are braided over the electroluminescent core. Preferably, the braid covers 50% of the electroluminescent core although more or less coverage may be used in specific applications.

In the embodiment shown in FIG. 3, a core conductor 301 is surrounded by a first insulation layer 302, which is surrounded by a luminescing layer 304. The luminescing layer 304 is surrounded by a second insulation layer 306, having embedded within it an electrode 305.

Figure 4:
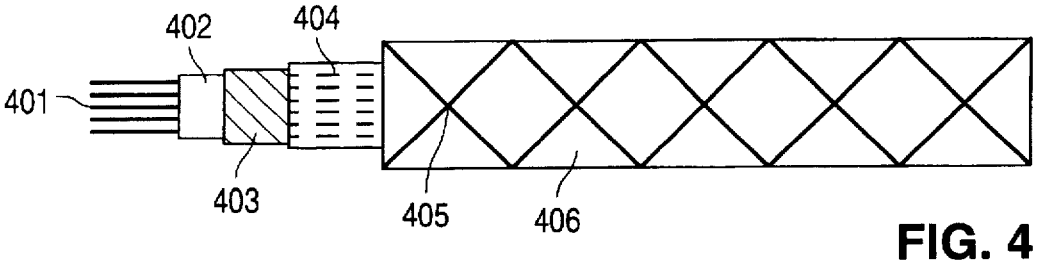
FIG. 4 shows a longitudinal elevation of the electroluminescent filament of the invention.

In the embodiment shown in FIG. 4, a core conductor 401 is surrounded by a first insulation layer 402, which is surrounded by an interlayer 403. The interlayer 403, is surrounded by the luminescing layer 404, which is surrounded by a second insulation layer 406, having embedded within it an electrode 405. The interlayer 403 is preferably an adhesion promoting interlayer, but may also serve some other purpose in improving the operation of the filament.

Figure 5:
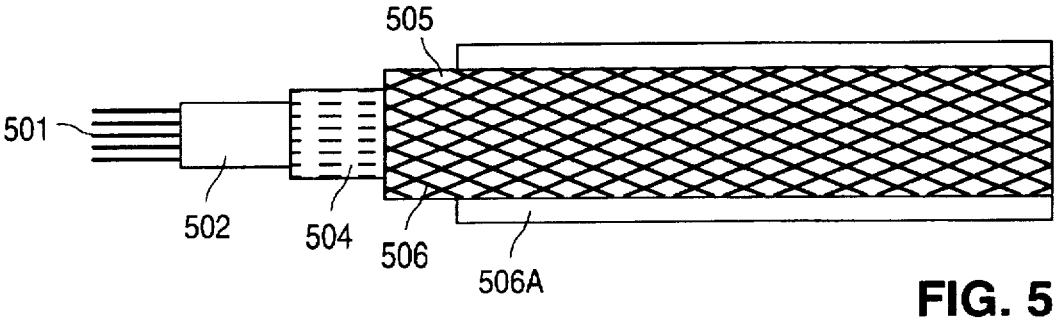
FIG. 5 shows a longitudinal elevation of the electroluminescent filament of the invention.

In the embodiment shown in FIG. 5, a core conductor 501 is surrounded by a first insulation layer 502, which is surrounded by surrounded by the luminescing layer 504. The luminescing layer 504 is surrounded by a second insulation layer 506. The second insulation layer 506 is surrounded by an electrode 505, which is surrounded by an additional protective layer **506*a*. The additional protective layer 506*a*** may be of any of the materials generally disclosed herein.

Figure 6:
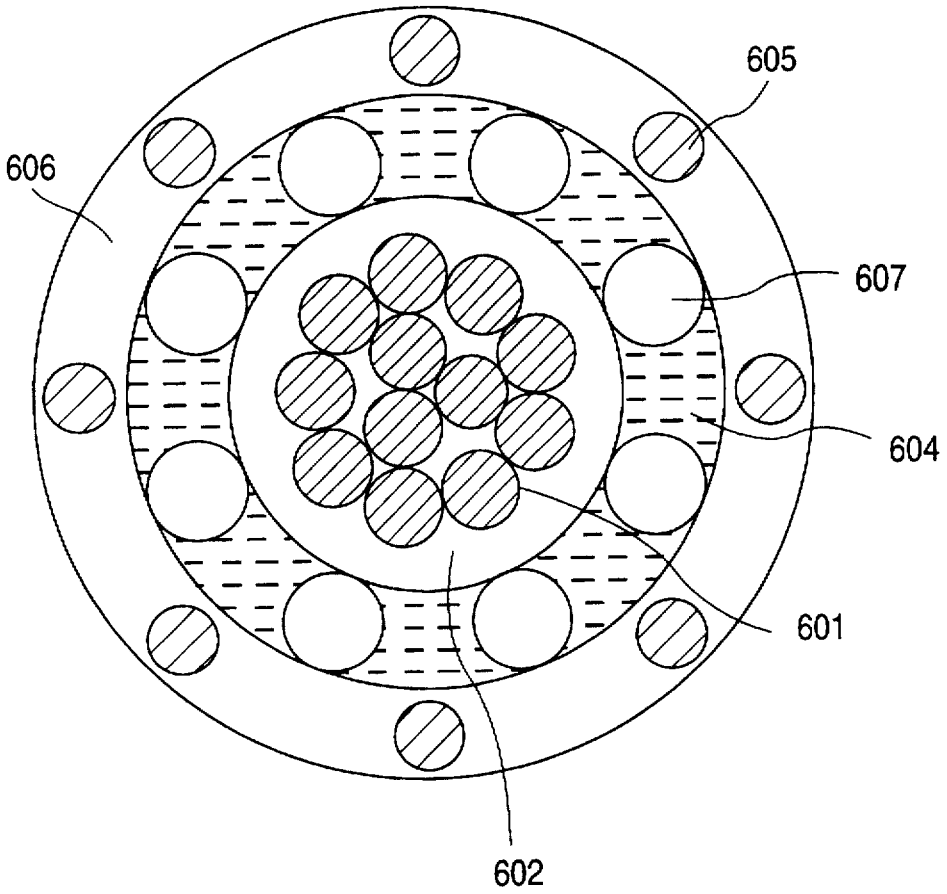
FIG. 6 shows a cross-section of an embodiment of the electroluminescent filament of the invention.

In an embodiment, shown in FIG. 6, a dielectric braid 607 surrounds the first insulation layer 602. To form the dielectric braid 607, a dielectric fiber is braided, spiral wrapped, or applied using a combination of both geometries, onto the first insulation layer 602. The dielectric braid 607 may also be produced by braiding, spiral wrapping, or using a combination of both geometries, a dielectric fiber onto the core conductor 601, such that the dielectric braid 607 surrounds the core conductor 601. The dielectric braid 607 also surrounds the core conductor 601, or the first insulation layer 602 that surrounds the core conductor 601.

Generally, dielectric braiding may be used in any of the layers of the invention, using dielectric fibers as described below.

The dielectric fibers forming the dielectric braids described herein may be made of glass, Kevlar®, polyester, acrylate, or other organic or inorganic materials suitable for use as dielectric fibers. The luminescing layer(s) described herein is applied over this dielectric braid. The dielectric fiber layer then acts as a coating thickness controller and may aid in adhering the luminescent layer to the core conductor.

This adhesion improvement is particularly helpful when the first insulation layer is a low friction and/or low adhesion coating, such as a fluoropolymer coating. Additionally, the dielectric fiber layer provides improved resistance to "cut-through" and improved axial strength because the dielectric fiber layer will act as a strength member. The electrode described herein may be then directly applied to the phosphor containing dielectric fiber layer, and the second insulation layer described herein is applied to the electrode.

Figure 7:
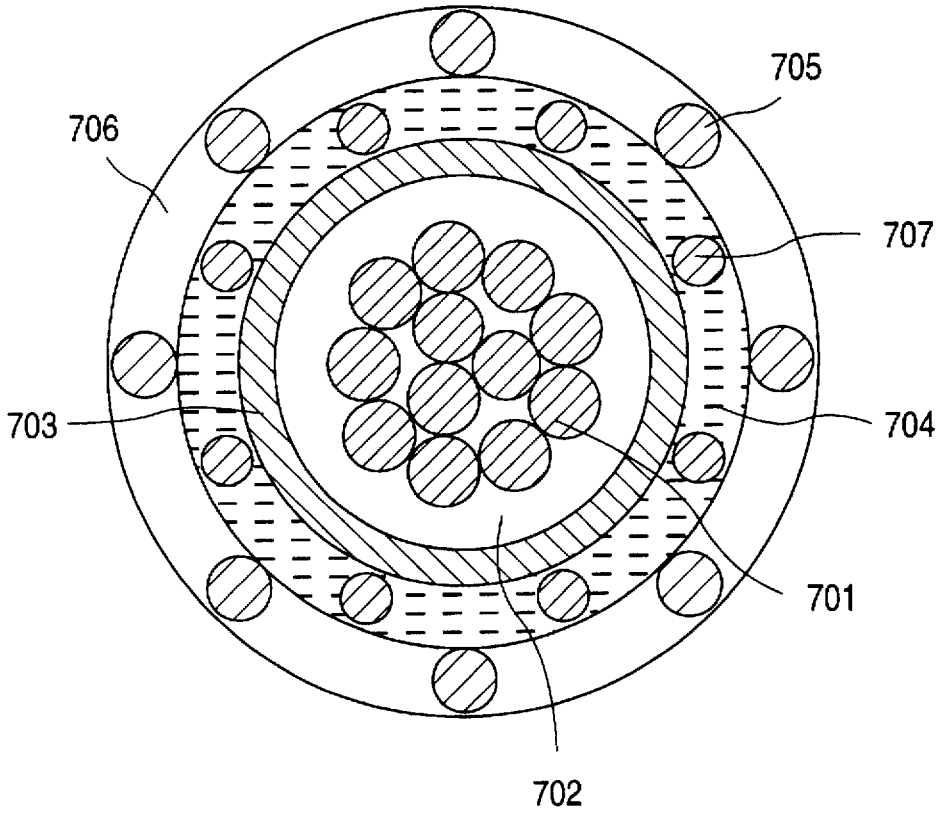
FIG. 7 shows a cross-section of an embodiment of the electroluminescent filament of the invention.

In another embodiment, shown in FIG. 7, the core conductor 701 is surrounded by a first insulation layer 702, which is surrounded by an interlayer 703. The interlayer 703 is surrounded by a dielectric braid 707, similar to the dielectric braid 607 of FIG. 6. The luminescing layer 704 is coated over the dielectric braid 707, similar to the relationship between the luminescing layer 604 and the dielectric braid 607 of FIG. 6. Surrounding the luminescing layer 704 is the second insulation layer 706, having embedded within it the electrode 705.

Figure 8:
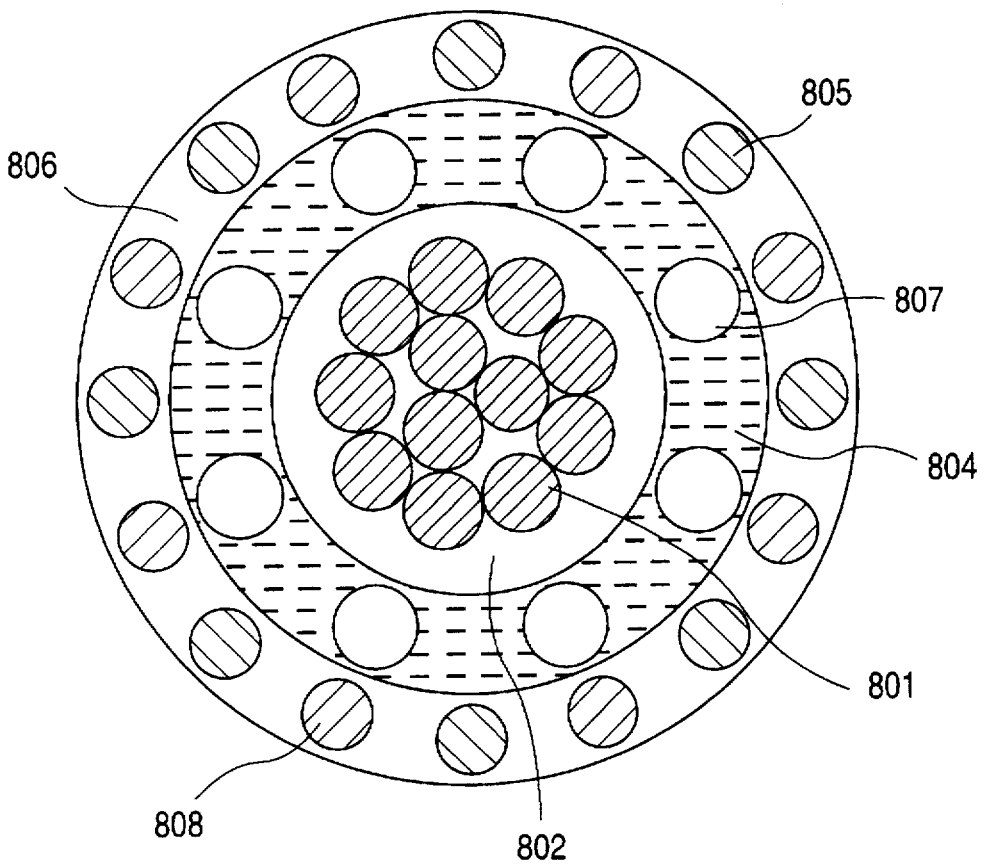
FIG. 8 shows a cross-section of an embodiment of the electroluminescent filament of the invention.

In another embodiment, shown in FIG. 8, the core conductor 801 is surrounded by a first insulation layer 802, which is surrounded by a dielectric braid 807, similar to the dielectric braid 607 of FIG. 6. The luminescing layer 804 is coated over the dielectric braid 807, similar to the relationship between the luminescing layer 604 and the dielectric braid 607 of FIG. 6. Surrounding the luminescing layer 804 is the second insulation layer 806, having embedded within it both the electrode 805 and a second dielectric braid 808. The second dielectric braid 808 may be of the same materials as the dielectric braid already described.

Figure 9:
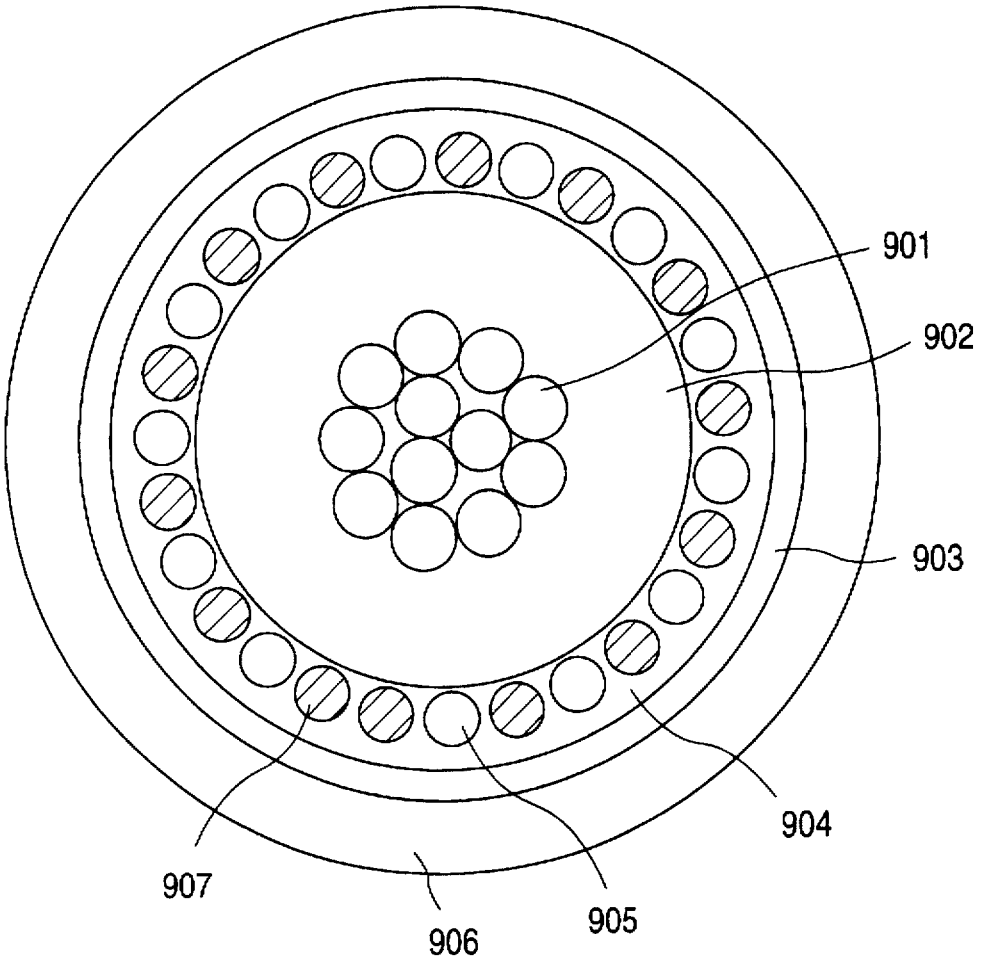
FIG. 9 shows a cross-section of an embodiment of the electroluminescent filament of the invention.

In another embodiment, shown in FIG. 9, the electrode 901, for example a braided wire electrode, may be applied directly and on the first insulation layer 902, or the core conductor 901 directly. The entire structure is then coated with the material of the luminescing layer 904. The electrode 901 is then embedded in the luminescing layer 901. The electrode 905 thus applied may be combined with dielectric materials. For example, if the electrode 905 is a braided wire electrode, it may be combined so as to be co-braided with a dielectric braid 907 directly onto either the optional first insulation layer 902, or the core conductor 901 directly. An interlayer 903, for example an adhesion promoting interlayer, may also be present if desired.

Additional layers or fillers may be added, or the above mentioned layers may be modified. For example, the use of transparent colored materials and/or translucent materials in the layers may alter the spectrum of emitted light, thereby producing different colors. Opaque materials may be used in the layers, producing, for example, a striped product. Phosphorescent (i.e. "glow-in-the-dark"), and reflective materials may also be used. The reflective materials may be particulates, or they might be sheet material.

Other additives may be used to correct color output and filter the spectral emission. For example, a laser dye may be added to the phosphor composition or coated on top of the phosphor composition or coated on top of the phosphor coating. This material will alter the spectral emission.

Additional layers, not herein described, may be added, as long as they result in a usable electroluminescent filament, as would be recognized by one of ordinary skill.

Included hereafter is an example embodiment of the invention. This example is merely illustrative, and not intended to limit the scope of the invention in any way.

EXAMPLE

A core conductor, comprised of a 19 strand bundle of 50 gauge wire, is selected. The entire bundle has a 2 mil thick fluoropolymer insulation coating that forms the first insulation layer. The first insulation layer is then coated with a particulate composite of an 80/20% by weight phosphor powder and resin mixture.

The particulate composite is prepared as a solution/suspension by mixing the appropriate ratio of phosphor powder and resin with a 50/50 mixture of acetone and dimethylacetamide. The viscosity of the solution/suspension may be adjusted by varying the solvent/solids ratio. To apply the coating, the core conductor is passed through a vertically oriented reservoir of phosphor composite, with a coating die at the bottom of the reservoir controlling the coating's thickness during the deposition process. The solvents are removed from the wet coating as the wire passes through a series of in-line, heated tube furnaces. The result is a solidified composite coating containing the phosphor. Using a binary blend of solvents assists the drying process, as the two solvents evaporate at different rates due to differences in boiling points. The finished product is a uniform, concentric and approximately 2 mil thick phosphor coating forming the luminescing layer on the first insulation layer.

Next, a 16-count (number of carriers) braider is used to produce a 50% coverage of 1 mil diameter wire over the luminescing layer. This braid forms the electrode.

Finally, a second coating reservoir with an appropriate diameter sizing die is used to apply the second insulation layer onto the wire. The coated filament is passed through in-line tube furnaces to convert the second insulation layer into its final form.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. An electroluminescent filament comprising:

(a) a core conductor of multiple strands of conductive or semiconductive material which strands are in physical contact with one another;

(b) a first insulating layer surrounding the multistrand core conductor;

(c) a luminescing layer surrounding the first insulating layer;

(d) a second insulating layer surrounding the luminescing layer; and (e) a braided electrode embedded in the second insulating layer;

wherein the electroluminescent filament has an outside diameter of no more than about 0.02 inches.

2. The electroluminescent filament of claim 1, wherein the electrode covers about 50% of the surface of the luminescing layer.

3. An electroluminescent filament comprising:

a core conductor consisting of multiple strands of conductive or semiconductive material which strands are in physical contact with one another;

a luminescing layer surrounding the multistrand core conductor; and a braided electrode surrounding the multistrand core conductor.

4. The electroluminescent filament of claim 3, wherein the braided electrode is embedded in the luminescing layer.

5. The electroluminescent filament of claim 4, further comprising an outer insulation layer surrounding the luminescing layer.

6. The electroluminescent filament of claim 3, wherein the braided electrode surrounds the luminescing layer.

7. The electroluminescent filament of claim 4, further comprising an outer insulation layer surrounding the luminescing layer, and wherein the braided electrode is embedded in the outer insulation layer.

8. The electroluminescent filament of claim 3, further comprising an insulation layer disposed between the multistrand core conductor and the luminescing layer.

9. The electroluminescent filament of claim 3, further comprising an adhesion interlayer between any two of the layers.

10. The electroluminescent filament of claim 3, wherein the luminescing layer comprises a phosphor.

11. The electroluminescent filament of claim 10, wherein the phosphor comprises a zincsulfide encapsulated phosphor and an activator selected from the group consisting of copper, manganese and mixtures thereof.

12. The electroluminescent filament of claim 5, further comprising a first dielectric braid embedded in the luminescing layer.

13. The electroluminescent filament of claim 5, further comprising a second dielectric braid embedded in the outer insulation layer.

14. The electroluminescent filament of claim 7, further comprising a second dielectric braid embedded in the outer insulation layer.

15. The electroluminescent filament of claim 3, wherein the electrode comprises an elongated oriented polymer material.

16. An electroluminescent filament comprising:

a core conductor consisting of multiple strands of stainless steel which are in contact with one another, each strand having a diameter of about 0.001 inch;

a luminescing layer surrounding the multistrand core conductor; and a braided electrode surrounding the multistrand core conductor.

* * * * *